US009126232B2

(12) United States Patent
Saint-Jacques

(10) Patent No.: US 9,126,232 B2
(45) Date of Patent: Sep. 8, 2015

(54) METHOD OF PROTECTING A SURFACE

(71) Applicant: Pratt & Whitney Canada Corp., Longueuil (CA)

(72) Inventor: Philippe Saint-Jacques, Montreal (CA)

(73) Assignee: PRATT & WHITNEY CANADA CORP., Longueuil, Quebec ( * ) Notice: Subject to any disclaimer, the term of this patent is extended or adjusted under 35 U.S.C. 154(b) by 99 days.

(21) Appl. No.: 13/772,807

(22) Filed: Feb. 21, 2013

(65) Prior Publication Data

US 2014/0234555 A1 Aug. 21, 2014

(51) Int. Cl.

| | |
|---|---|
| ***B05D 1/32*** | (2006.01) |
| ***F01D 5/28*** | (2006.01) |
| ***C23C 4/02*** | (2006.01) |
| ***C23C 4/18*** | (2006.01) |

(52) U.S. Cl.

CPC . *B05D 1/322* (2013.01); *C23C 4/02* (2013.01); *C23C 4/18* (2013.01); *F01D 5/288* (2013.01); *F05D 2230/90* (2013.01)

(58) Field of Classification Search

None

See application file for complete search history.

(56) References Cited

U.S. PATENT DOCUMENTS

| | | | | |
|---|---|---|---|---|
| 5,695,659 | A * | 12/1997 | Dickie | 216/48 |
| 5,800,695 | A | 9/1998 | Kang et al. | |
| 5,902,647 | A | 5/1999 | Venkataramani et al. | |
| 6,265,022 | B1 | 7/2001 | Pernihough et al. | |
| 6,335,078 | B2 * | 1/2002 | Venkataramani et al. | 428/139 |
| 7,083,824 | B2 | 8/2006 | Stankowski et al. | |
| 7,147,899 | B2 | 12/2006 | Fernihough et al. | |
| 7,192,622 | B2 | 3/2007 | Fernihough et al. | |
| 7,772,314 | B2 | 8/2010 | Fernihough et al. | |
| 2004/0146657 | A1 * | 7/2004 | Heuser et al. | 427/446 |
| 2006/0266285 | A1 * | 11/2006 | Fernihough et al. | 118/504 |
| 2009/0286003 | A1 * | 11/2009 | Reynolds et al. | 427/510 |
| 2011/0305583 | A1 | 12/2011 | Lee et al. | |

FOREIGN PATENT DOCUMENTS

| | | |
|---|---|---|
| EP | 1365039 | 11/2003 |
| EP | 1387040 | 2/2004 |

* cited by examiner

*Primary Examiner* — Timothy Meeks

*Assistant Examiner* — Michael P Rodriguez

(74) *Attorney, Agent, or Firm* — Norton Rose Fulbright Canada

(57) ABSTRACT

A method of masking part of a surface of a wall of a gas turbine component including at least one area having cooling holes defined therein, the method including applying a viscous curable masking compound to the part of the surface over an entirety of each of the at least one area, including blocking access to the cooling holes from the surface by applying the masking compound over the cooling holes without completely filling the cooling holes with the masking compound, and forming a respective solid masking element completely covering each of the at least one area and the cooling holes defined therein by curing the masking compound.

20 Claims, 5 Drawing Sheets

METHOD OF PROTECTING A SURFACE

TECHNICAL FIELD

The application relates generally to surface treatment of components and, more particularly, to a method of protecting part of a surface from such a surface treatment.

BACKGROUND OF THE ART

A variety of surface treatments are routinely used in the manufacture of gas turbine engine components, including abrasive or thermal treatments. It is known to protect cooling holes in a component from such surface treatment by applying a masking compound only in the cooling holes, which are individually filled, thus typically requiring the position of each hole on the component to be known. However, such a process typically increases in complexity and length as the number of cooling holes is increased.

SUMMARY

In one aspect, there is provided a method of masking part of a surface of a wall of a gas turbine component, the surface including at least one area having cooling holes defined therein, the method comprising: applying a viscous curable masking compound to the part of the surface over an entirety of each of the at least one area, including blocking access to the cooling holes from the surface by applying the masking compound over the cooling holes without completely filling the cooling holes with the masking compound; and forming a respective solid masking element completely covering each of the at least one area and the cooling holes defined therein by curing the masking compound.

In another aspect, there is provided a method of applying a surface treatment to at least one selected portion of a surface of a component, the method comprising: protecting at least one area of the surface adjacent the at least one selected portion by applying a viscous curable masking compound to the surface over an entirety of each of the at least one area, including blocking access from the surface to cooling holes defined in one or more of the at least one area by applying the masking compound continuously over the cooling holes without completely filling the cooling holes with the masking compound; forming a respective solid masking element completely covering each of the at least one area by curing the masking compound; applying the surface treatment to the at least one selected portion; and removing the masking compound.

In a further aspect, there is provided a method of masking an area of a surface of a gas turbine component, the method comprising: relatively displacing the component and a nozzle of a pneumatic distribution system while maintaining a predetermined relative distance between a tip of the nozzle and the surface; expelling a viscous curable masking compound from the nozzle onto the area during the relative displacement until the area is completely covered by the masking compound; curing the masking compound to form a solid masking element completely covering the area.

DESCRIPTION OF THE DRAWINGS

Reference is now made to the accompanying figures in which:

FIG. 2*a* is a schematic plan view of a portion of a shell of a combustor of a gas turbine engine such as shown in FIG. 1, in accordance with a particular embodiment;

DETAILED DESCRIPTION

Figure 1:
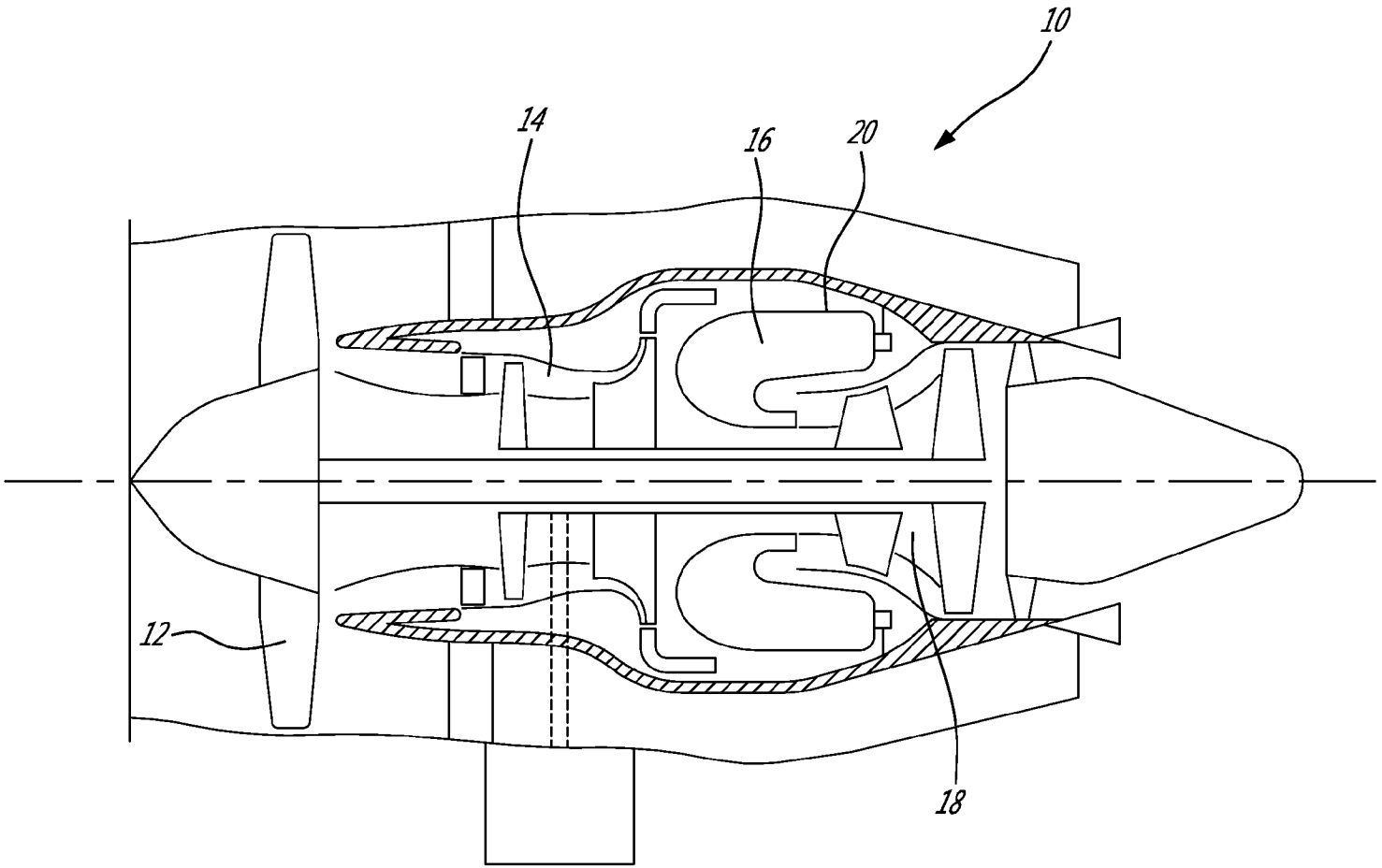
FIG. 1 is a schematic cross-sectional view of a gas turbine engine.

FIG. 1 illustrates a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases.

Figure 2B:
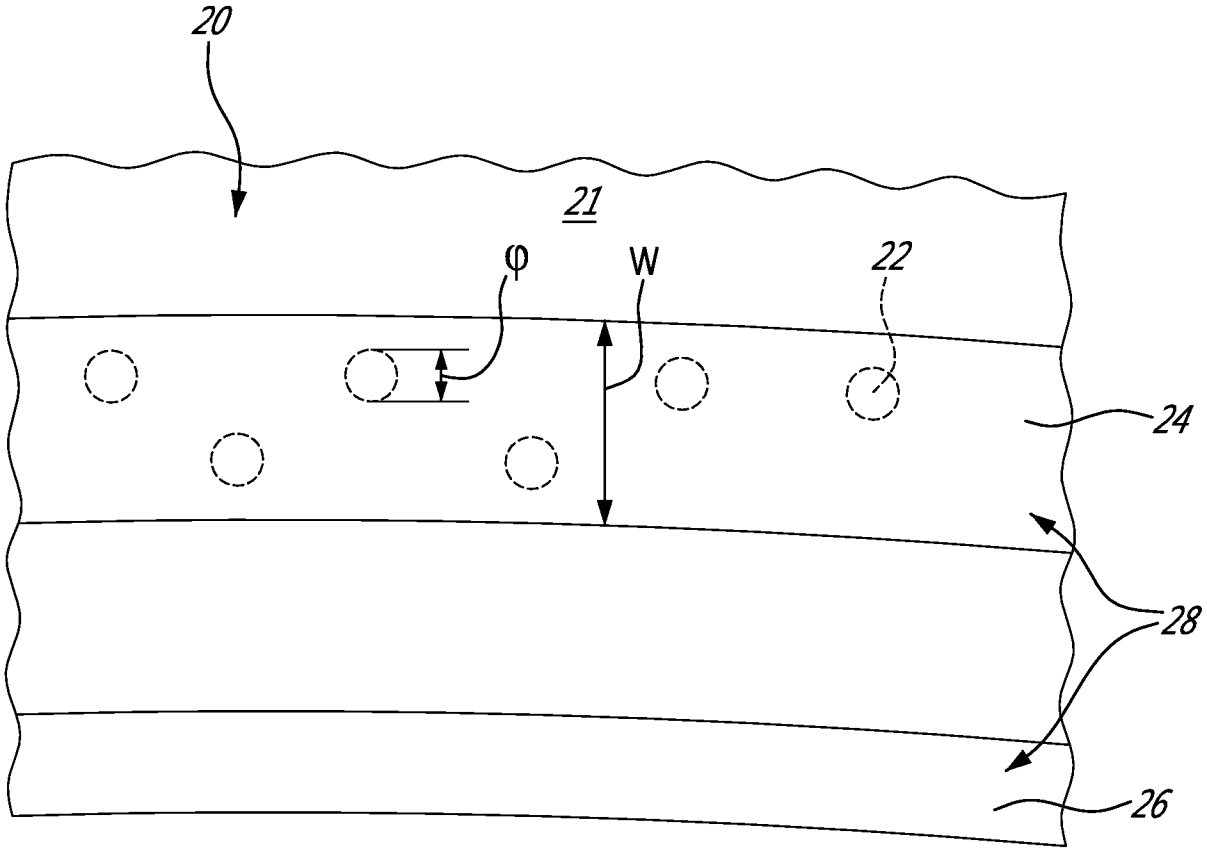
FIG. 2*b* is a schematic tridimensional view of a portion of the shell of the combustor of a gas turbine engine such as shown in FIG. 1, in accordance with a particular embodiment.
Figure 2B:
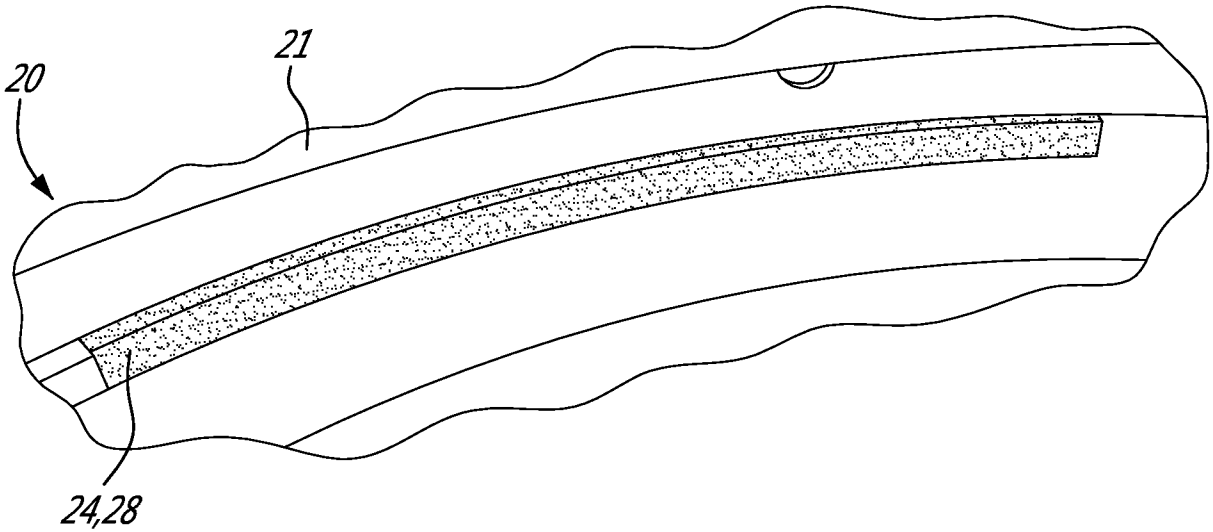

Referring to FIGS. 2*a*-2*b*, the combustor 16 includes a shell 20 having a plurality of cooling holes 22 defined therein. In a particular embodiment, a ceramic thermal barrier coating is applied on the surface 21 of the shell 20, e.g. through plasma spray deposition, after the surface 21 is appropriately prepared, e.g. grit blasted, in preparation for the coating application. However, the cooling holes 22 are protected before the coating is applied to avoid being blocked by the coating. In a particular embodiment, the cooling holes 22 are distributed in spaced apart groups with each group being located in a respective cooling area 24 defined on the surface 21.

A portion of the surface of the combustor shell 20 is thus protected before the surface treatment (e.g. coating application, grit blasting) is performed. In a particular embodiment, the portion to be protected includes the cooling areas 24, and further includes one or more area(s) 26 of the surface 21 which does not have cooling holes defined therein, for example areas used for assembly with another component, e.g. where welding is performed. The protected areas 24, 26 are all spaced apart from one another.

Figure 3:
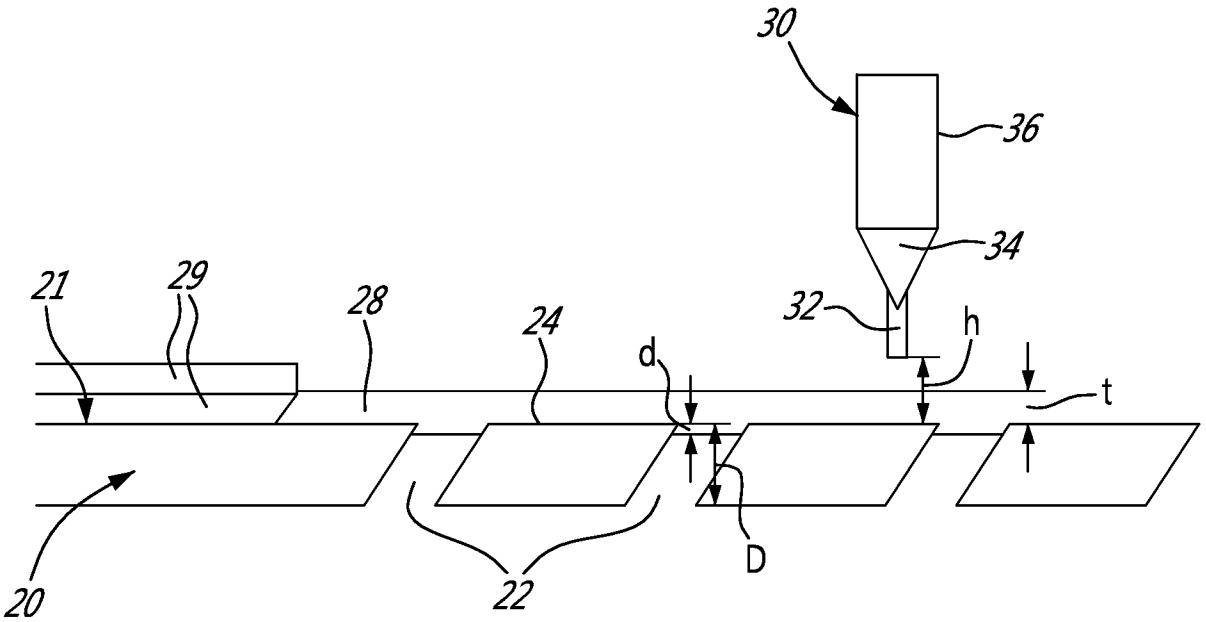
FIG. 3 is a schematic cross-sectional view of a part of a component such as the shell of FIGS. 2*a*-2*b*, showing application of a masking compound thereon in accordance with a particular embodiment.

The areas 24, 26 are protected through the application of a viscous curable masking compound 28 thereon. The masking compound 28 is applied to completely and separately cover each area 24, 26. As can be seen more clearly in FIG. 3, the masking compound 28 is applied over the cooling areas 24 without completely plugging the cooling holes 22, i.e. each cooling hole 22 is free of the masking compound along at least part of its depth D. Once the masking compound 28 is cured, the surface 21 may be treated, e.g. one or more layers of coating 29 may be applied to the surface 21.

In a particular embodiment, the masking compound 28 penetrates each hole 22 along a distance d less than half of the depth D of the hole. In a particular embodiment, and particularly for small cooling holes, e.g. cooling holes having a diameter of 0.1 inch (2.54 mm) or less, the masking compound 28 penetrates in each hole along a distance d less than the diameter cp of the hole. In a particular embodiment, the masking compound 28 does not substantially penetrate in the holes 22. The limited penetration of the masking compound 28 in the holes 22 may facilitate removal of the masking compound 28, particularly for mechanical removal.

The depth of penetration d of the masking compound 28 is controlled by selecting a masking compound having an appropriate viscosity. The viscosity of the masking compound is also selected such that the compound remains where applied on the surface 21, e.g. to avoid dripping when applied to vertical or inclined surfaces. In a particular embodiment, the masking compound 28 has a viscosity of at least 15000 cP. In another particular embodiment, the masking compound 28 has a viscosity of about 20000 cP. In a further particular embodiment, the masking compound 28 has a viscosity of about 40000 cP. In a further particular embodiment, the masking compound 28 has a viscosity within a range of from about 15000 cP to about 40000 cP.

Figure 4:
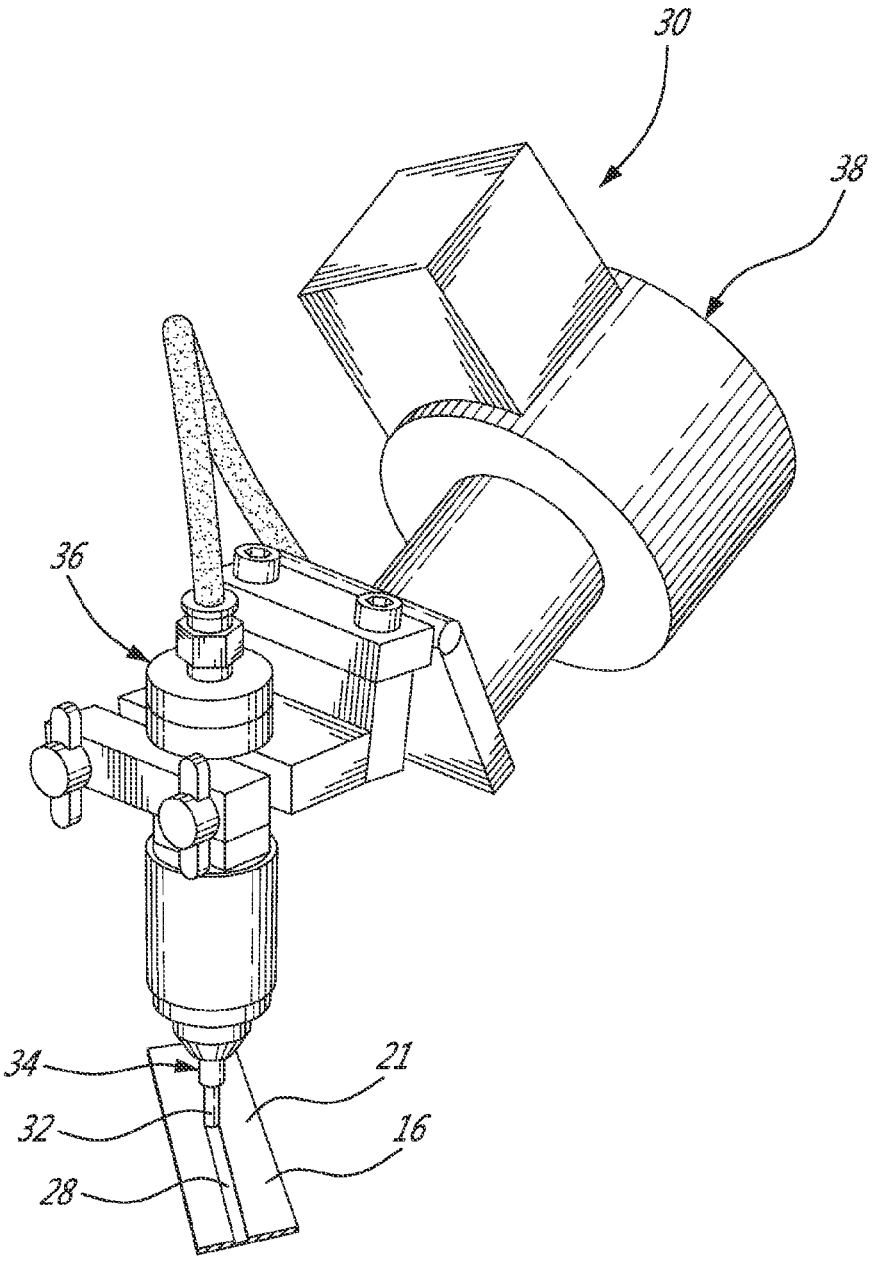
FIG. 4 is a schematic cross-sectional view of a system for applying a masking compound on a component such as shown in FIG. 3, in accordance with a particular embodiment.

The masking compound 28 is applied using an automated dispensing tool 30 having an appropriate dispensing tip 32. In the embodiment shown in FIGS. 3-4, the masking compound 28 is applied using a pneumatic distribution system 36 including a nozzle 34 through which the masking compound 28 is delivered. A relative movement is created between the component 20 and the nozzle 34, for example by rotating the component 20 around its central axis and the dispensing tip 32 is maintained at a predetermined distance h from the surface 21 as it is moved across the width w of the area 24, 26 until the area 24, 26 is completely covered. In another embodiment, the relative movement may be performed by moving both the nozzle 34 and the component 20, or by moving the nozzle 34 only.

In a particular embodiment, the nozzle 34 and distribution system are mounted on a CNC machine 38 (FIG. 4) or any other robotic machine programmable to follow the geometry of the component 20. The position and/or profile of the surface 21 is measured before or as the masking compound 28 is applied to be able to maintain the dispensing tip 32 at a predetermined distance therefrom during application. The position and/or profile of the surface 21 may be measured using any appropriate method, for example touch probe, laser scanning, etc.

The thickness of the masking compound 28 to be applied is selected such as to be sufficient to be resistant to the surface treatment being performed, while being thin enough to avoid shading of the adjacent parts of the surface 21, i.e. to ensure that the surface treatment is correctly applied to the surface 21 immediately adjacent the masked areas 24, 26. In a particular embodiment, the thickness t of the masking compound 28 applied is from about 0.040 inch (1.016 mm) to about 0.050 inch (1.27 mm), preferably about 1 mm.

The diameter of the dispensing tip 32 is determined, for example measured under a microscope. An appropriate disposition model based on volumetric continuity and experimental flow data is used to model the behaviour of the masking compound 28 between the dispensing tip 32 and the surface 21, based on the diameter of the dispensing tip 32, the predetermined distance h between the dispensing tip 32 and the surface 21, and the pressure available from the pneumatic system. The necessary nominal relative speed between the nozzle 34 and the surface 21 corresponding to the desired masking compound thickness on the surface 21 is then calculated. Depending on the relative speed and viscosity, the width of the line of masking compound 28 deposited on the cooling area may be for example 60% to 150% of the dispensing tip 32. Once the nominal relative speed is calculated, experimentation is carried out to adjust the actual speed to obtain the desired coverage of the areas 24, 26.

In a particular embodiment, and using a masking compound having a viscosity of about 15000 cP, the dispensing tip 32 has a diameter of about 1 mm and is maintained at a distance h of from 0.5 mm to 2 mm from the surface 21 and oriented such as to be normal to the surface 21 to deposit the masking compound 28 with a thickness t of around 1 mm. The injection pressure is at most 100 psi, preferably from 50 to 80 psi. The relative speed between the nozzle 34 and the surface 21 is from 20 to 100 mm/sec, preferably about 50 mm/sec. Other parameters may be used, as dictated by the characteristics of the masking compound 28, the geometry of the nozzle 34 and the coated surface geometry.

In a particular embodiment, the masking compound 28 is applied on the surface 21 directly to the desired thickness, i.e. in a single layer, without going over the same area twice.

Once the masking compound 28 completely covers the area(s) 24, 26 to be protected, it is cured using any appropriate method depending on its composition. In a particular embodiment, the masking compound 28 is silicon-based and includes a ultra-violet curable resin such as acrylic urethane, and curing is thus performed by exposing the masking compound 28 to ultra-violet light. Alternately, the masking compound 28 may be heat curable, or curable through a combination of heat and ultra-violet light. Once cured, the masking compound 28 forms a solid masking element completely covering the respective area 24, 26. In the particular embodiment shown, the solid masking element is continuous across the entire area 24, 26.

The surface treatment is then performed, e.g. the surface 21 is grit blasted and the coating 29 is applied, after which the masking compound 28 is removed. In a particular embodiment, the masking compound 28 is removed mechanically. The component 20 and masking compound 28 may be submerged in an appropriate liquid before the mechanical removal to facilitate the removal process, for example hot water and/or an appropriate solvent.

Although the process has been described using a combustor shell 20 as an example of application, it is understood that a similar process described can be applied to any component of the gas turbine engine 10 having portions requiring protection from any appropriate surface treatment. For example, the process can be used to protect surface portions of other components from the application of thermal barrier coating (e.g. gearbox); to protect surface portions of any components from shot penning (e.g. blade); to protect surface portions of any components from grit-blasting, painting, etc. Portions of these surfaces may be protected during original manufacturing steps or during later repairs.

The masking process can also be used to apply a mask on certain cooling holes before performing airflow tests, for example for rotor blades, and/or to form a gasket on a hard masking element used to cover part of a component during the application of a surface treatment, for example an annular protecting element re-used to protect a region of each combustor from the application of a coating through plasma spray.

The above description is meant to be exemplary only, and one skilled in the art will recognize that changes may be made to the embodiments described without departing from the scope of the invention disclosed. Modifications which fall within the scope of the present invention will be apparent to those skilled in the art, in light of a review of this disclosure, and such modifications are intended to fall within the appended claims.

The invention claimed is:

1. A method of masking part of a surface of a wall of a gas turbine component, the surface including at least one area having cooling holes defined therein, the method comprising:

applying a viscous curable masking compound to the part of the surface over an entirety of each of the at least one area, including blocking access to the cooling holes from the surface by applying the masking compound over the cooling holes without completely filling the cooling holes with the masking compound, wherein blocking access to the cooling holes includes relatively displacing the component and a nozzle of an automated distribution system, and expelling the masking compound from the tip of the nozzle onto the area while relatively displacing the component and the nozzle; and forming a respective solid masking element completely covering each of the at least one area and the cooling holes defined therein by curing the masking compound.

2. The method as defined in claim 1, wherein the part of the surface further includes at least one additional area without cooling holes defined therein, the method further comprising:

applying the viscous curable masking compound to the part of the surface over an entirety of each of the at least one additional area; and forming a respective solid masking element completely covering each of the at least one additional area by curing the masking compound.

3. The method as defined in claim 1, wherein applying the viscous material continuously over the cooling holes is performed such that the masking compound penetrates in each hole along a distance corresponding to less than half of a depth of the hole.

4. The method as defined in claim 1, wherein applying the viscous material continuously over the cooling holes is performed such that the masking compound penetrates in each hole along a distance corresponding to less than a diameter of the hole.

5. The method as defined in claim 1, wherein the automated distribution system is a pneumatic distribution system, and relatively displacing the component and the nozzle of the pneumatic distribution system is performed while maintaining a predetermined relative distance between the of the nozzle and the surface.

6. The method as defined in claim 1, wherein relatively displacing the component and the nozzle includes rotating the component about a central axis thereof.

7. The method as defined in claim 1, wherein curing the masking compound includes exposing the masking compound to ultra-violet light.

8. The method as defined in claim 1, wherein each area has a width at most 4 times that of a diameter of the cooling holes defined therein.

9. The method as defined in claim 1, wherein the masking compound is applied to the part of the surface with a thickness of from about 1.016 mm to about 1.27 mm.

10. The method as defined in claim 1, wherein the masking compound has a viscosity of at least 15000 cP.

11. A method of applying a surface treatment to at least one selected portion of a surface of a component, the method comprising:

protecting at least one area of the surface adjacent the at least one selected portion by applying a viscous curable masking compound to the surface over an entirety of each of the at least one area, including blocking access from the surface to cooling holes defined in one or more of the at least one area by applying the masking compound continuously on the surface over the cooling holes without completely filling the cooling holes with the masking compound, wherein blocking access from the surface to the cooling holes includes:

reactively displacing the component and a nozzle of an automated distribution system, and distributing the masking compound on the surface over the cooling holes through the nozzle while relatively displacing the component and the nozzle;

forming a respective solid masking element completely covering each of the at least one area by curing the masking compound;

applying the surface treatment to the at least one selected portion; and after the surface treatment is applied, removing the masking compound.

12. The method as defined in claim 11, wherein applying the surface treatment includes applying a coating using plasma spray.

13. The method as defined in claim 11, wherein removing the masking compound includes mechanically removing the masking compound from the holes.

14. The method as defined in claim 11, wherein covering the cooling holes is performed such that the masking compound penetrates in each hole along a distance corresponding to less than half of a depth of the hole.

15. The method as defined in claim 11, wherein the automated distribution system is a pneumatic distribution system, and relatively displacing the component and the nozzle of the pneumatic distribution system is performed while maintaining a predetermined relative distance between the tip of the nozzle and the surface.

16. The method as defined in claim 11, wherein curing the masking compound includes exposing the masking compound to ultra-violet light.

17. A method of masking an area of a surface of a gas turbine component, the method comprising:

relatively displacing the component and a nozzle of a pneumatic distribution system while maintaining a predetermined relative distance between a tip of the nozzle and the surface as the nozzle moves along a width and a length of the area;

expelling a viscous curable masking compound from the nozzle onto the area during the relative displacement until the area is completely covered by the masking compound;

curing the masking compound to form a solid masking element completely covering the area.

18. The method as defined in claim 17, wherein relatively displacing the component and the nozzle includes rotating the component about a central axis thereof.

19. The method as defined in claim 17, wherein the masking compound is applied with a thickness of from about 1.016 mm to about 1.27 mm.

20. The method as defined in claim 17, wherein the masking compound has a viscosity of at least 15000 cP, and expelling the viscous curable masking compound from the nozzle onto the area includes applying the masking compound continuously over cooling holes defined in the area.

* * * * *